United States Patent [19]

Raasakka et al.

[11] 4,439,957

[45] Apr. 3, 1984

[54] BUILDING STRUCTURE AND METHODS OF CONSTRUCTING AND UTILIZING SAME

[76] Inventors: Benny O. Raasakka, 362 Wekiva Cove Rd., Longwood, Fla. 32779; Alfred Evans, 6176 Miller Rd., Swartz Creek, Mich. 48473

[21] Appl. No.: 265,685

[22] Filed: May 20, 1981

[51] Int. Cl.[3] ..... E06B 1/04

[52] U.S. Cl. ..... 52/79.1; 52/210; 52/289; 52/690; 52/693

[58] Field of Search ..... 52/79.1, 79.2, 79.3, 52/90, 236.3, 690, 693, 289, 271, 210, 643

[56] References Cited

U.S. PATENT DOCUMENTS

| | | | |
|---|---|---|---|
| 2,151,399 | 3/1939 | White | 52/289 |
| 2,702,413 | 2/1955 | Kamisato | 52/289 |
| 3,992,829 | 11/1976 | Schellberg | 52/271 |
| 4,065,895 | 1/1978 | Shank | 52/289 |
| 4,106,258 | 8/1978 | Lindsay | 52/643 |

*Primary Examiner*—R. P. Machado

*Attorney, Agent, or Firm*—Irving M. Weiner; Pamela S. Burt; John L. Shortley

[57] ABSTRACT

A housing module which is formed as a box-beam structure, and has sufficient rigidity and strength so that it can be used to span distances of relatively great length. The housing unit is able to be prefabricated and can be readily transported without the need for additional support or stiffening members to prevent damage from excess flexure. Further, the unit can be simply put in place on site without any additional stiffening or strengthing members. In addition, the units can be stacked one over the other, thus greatly increasing their flexibility to the architect.

14 Claims, 7 Drawing Figures

BUILDING STRUCTURE AND METHODS OF CONSTRUCTING AND UTILIZING SAME

BACKGROUND OF THE INVENTION

1. Field of the Invention

This invention relates to the field of prefabricated building construction, and particularly to the field of prefabricated modules which are used to build homes and/or office buildings. In recent years there has been an increasing number of homes built of prefabricated units which are shipped to the sites of the home or office to be erected, and simply placed into position or, in some instances joined with additional sections to form the building. Usually these are completely finished except for connection to plumbing, etc., and perhaps some decorative additions. The instant invention pertains to modules of this type which are designed to be more permanently installed than the typical truly trailerable vehicle.

2. Description of the Prior Art

Many homes comprise units which are prefabricated, and then transported to sites where they are more less permanently emplaced. Some involve several sections, usually two, which can be joined to form a larger home or office. Many of these units experience some difficulty in transport due to the way they are constructed. They are also designed solely to be individually supported at ground level as a trailer type home may be.

The units are designed to provide easy transport and erection, and this results in a preference for minimum weight in transport, and minimum erection loads on site. Often the span strength of floors, roofs, etc. is minimal. Further the tendency has been to employ standard building concepts in which walls rest on floor plates or beams, and roofs in turn are supported on side plates above the side walls. Such homes often require steel beams or like lower supports, either for trucking or ensuring satisfactory support in place, because the flooring support units are insufficient without further structural assistance.

The known units are also designed in general so as to be fully supported throughout their length, and often their width, by full wall construction. Some may employ simple spaced block columns or the like supports. These most likely will be those in which additional beams, or the like supports, are applied to the building structure, per se. For example, where steel beams have been placed below the building module for transport purposes, these can be also used at a site, when they are not removed, as part of the support for the building. In this case spaced columns of cement blocks can be placed to support the building adjacent the ground.

None of these buildings however are designed for in place bridging of substantial distances. Prefabricated modules are also not in general designed to be stacked one over the other such as in the making of a two-story home. Nor are modules provided which can be mounted on a lower module and projected a substantial distance beyond the side or end of the lower unit, and wherein the projecting section can be supported solely at its outer end.

Known design principles have also limited the ability to increase the energy efficiency of these building modules. Limited thickness, for example, of the walls, roofs and floors have restricted the amount of insulation which can be employed as well as the stiffness or strength that can be provided.

DESCRIPTION OF THE PRIOR ART PATENTS

The U.S. Pats. to White, No. 2,151,399, Kamisato, No. 2,702,413, Schellberg, et al, No. 3,992,829 and Shank, et al, No. 4,065,895 are believed to be representative of previously known building construction relating to the field of the invention.

U.S. Pat. No. 2,151,399 granted March, 1939 to White entitled "BUILDING CONSTRUCTION", shows the use of sheet metal channels for joists and risers. These channels are supported at their ends upon a foundation, and if necessary upon intermediate girders.

The channels are eventually filled with concrete, and it is contemplated that concrete floor slabs, and wall slabs will be employed. An outer wall is attached to the metal riser channels.

U.S. Pat. No. 2,702,413 granted Feb., 1955 to Kamisato entitled "PREFABRICATED WALL CONSTRUCTION", relates to the provision of prefabricated houses for the tropics. The structure includes a sill member on which are supported floor joists. The floor joists are notched and prefabricated wall panels which have a bottom plate are adapted to be mounted on the notched sections of the joists, and on the sill plate. The wall panels are secured to the joists and plates by nails.

U.S. Pat. No. 3,992,829 granted Nov., 1976 to Schellberg entitled "BUILDING STRUCTURE", discloses a method of providing rectangular box-like buildings.

According to Schellberg, wall panels are provided which can be joined at a site to produce a building. The wall panels comprise inner sheet members and outer panels secured to stretchers and stringers. The wall panel members have tongue and groove edges and an insulation panel is provided between the inner and outer sheath members and within the stretchers and stringers.

The panels are connected to the stringers and stretchers by nailing and gluing, and are connected to each other by gluing along the tongue and groove joists.

In addition upper and lower wall stretchers are provided. These are secured to the panel stretchers, by nailing and gluing, as well as to the outer and inner sheath members.

The outer sheath member of the wall panel extends above and below the inner sheath member and the stretchers a sufficient distance to provide for merging with horizontally extending members and panels.

U.S. Pat. No. 4,065,895 granted Jan., 1978, to Shank, entitled "WOOD BUILDING CONSTRUCTION", discloses a panelized building concept in which floor panels are formed of plywood members and joists, and are connected to wall panels. The wall panels have lower bands, studs, and plywood sheathing. Footing plates are used, and the wall panels are mounted on the footing plates, with the lower bands positioned to support the outer edges of the plywood portions of the floor panels.

The wall panels can be joined by means of bolts and nuts. These are passed through adjacent studs.

SUMMARY OF THE INVENTION

The invention provides a box-beam housing structure which can span substantial open unsupported distances compared to its length, yet which can be prefabricated and easily transported. The invention contemplates box-beam housing units which are self contained modules, which can be transported without the need for additional support, and without the fear of damage due to excessive flexing. In addition, the ability to span great lengths provides greater flexibility in design and architectural arrangement. Thus, single modules can be designed, which can be combined in a number of different ways to provide attractive homes, office modules, or the like. According to the invention, prefabricated box-beam structures are provided which can be combined to form larger homes. Futher, the units can be used to form a multiple level, or a single-story enclosure. In addition, because of the box-beam construction, various interesting arrangements of upper and lower units, and/or partially supported units can be provided. The box-beam modules can serve as a single unit, or can be united to form multiple story structures which have sections which can span, unsupported, a substantial distance. This provides the possibility of considerable variations in aspect of the housing units. Carports, overhanging decks, and arrangements on sloping land, can be considerably varied, thus greatly enhancing the architectural possibility. According to the invention, there are provided single fully formed units which can be horizontally or vertically combined. The units are fully self supporting, and are rigid without the need for additional supporting beams or braces being provided at the eventual site. Furthermore, the honeycomb-like structure in which the units are formed makes it possible to provide exterior and interior appearances that will have more the appearance of a home then that of a typical trailor-type unit.

Another aspect of this invention is the provision of an energy efficient module for forming buildings. According to the invention, wall thickness is considerably greater than that heretofore provided in module-type home construction. Further, an energy efficient heating and cooling concept is employed.

The invention also provides a unique framing system which not only enables the provision of greater energy conservation, but also greater rigidity to modules of the type needed for building attractive, sturdy and desirable homes, and other buildings.

According to the invention there is provided a box-like building module comprising a series of U-shaped stress members arranged in spaced serial order lengthwise of the module. These stress members comprise horizontally positioned truss members and pairs of vertically extending elements. The latter elements are positioned at spaced locations along the truss, and extend vertically along the truss, and then above the truss a substantial distance. Where the vertically extending members abut the truss, they are secured thereto in a load transmitting manner. A horizontally extending and vertically positioned sheath-like stress band extends along the full length of the series of stress members and is secured in stress transmitting manner to the vertically extending elements for a substantial portion of the vertical height thereof, to form a rigid stress absorbing unitary side structure. The horizontally positioned sheath-like stress band is received within notched portions of the vertically extending elements of the stress members, and extend from the lowermost ends thereof, upwardly a substantial distance. The horizontally extending stress band is also secured to the full height of the truss members at the connection between these members and the vertically extending elements of each of the U-shaped stress members.

A further sheath member extends along the full length of the series of U-shaped stress members, and is affixed to the horizontally extending sheath-like stress band for the full extent thereof, and also to the vertically extending elements of the stress members for the full extent thereof above the horizontally disposed sheath-like stress band.

Further, according to the invention, upper members are provided joining the U-shaped members to form a roof means integrally connected to the upper ends of the U-shaped stress members, and to the sheath member which overlies the sheath-like stress band, and there is thus formed a substantially rigid box-beam housing unit capable of spanning substantial distances between supports. The upper members comprise joist-like trusses positioned in vertical alignment with the U-shaped stress members. The trusses are also integrally connected to the sheath members, thus united therewith, and with the U-shaped stress members. Above the upper trusses there is provided a sheath-like roof member integrally connected to all of the trusses along the full extent thereof. On top of this there is provided a further rigid sheath member, and over this a rubber roof member is bonded.

Additional features and objects of the invention will be apparent from the following description of the drawings.

DETAILED DESCRIPTION OF PREFERRED EMBODIMENTS

Figure 1:
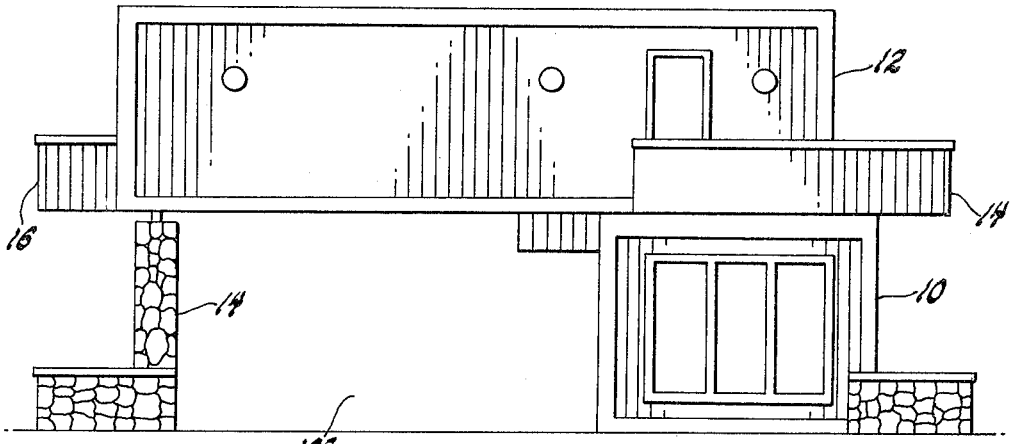
FIG. 1 is a front elevational view of a home constructed of modules provided in accordance with the invention.

Referring to FIG. 1, there is shown a module 10 which is seen from one end, and above it is a module 12, which is seen from one side. The module 12 is supported at one end by a wall 14, and at its opposite end it rests upon the lower module 10. The module can extend a substantial distance without vertical support beneath it, as shown in the figure. The space beneath the upper module can function as a carport, for example. A home such as constructed in accordance with what is shown in FIG. 1 can have its entrance position on the left side of the lower unit 10, and can have an upper deck 14 over the lower unit 10, as well as a deck 16 extending outwardly from the left side of the building.

Figure 2:
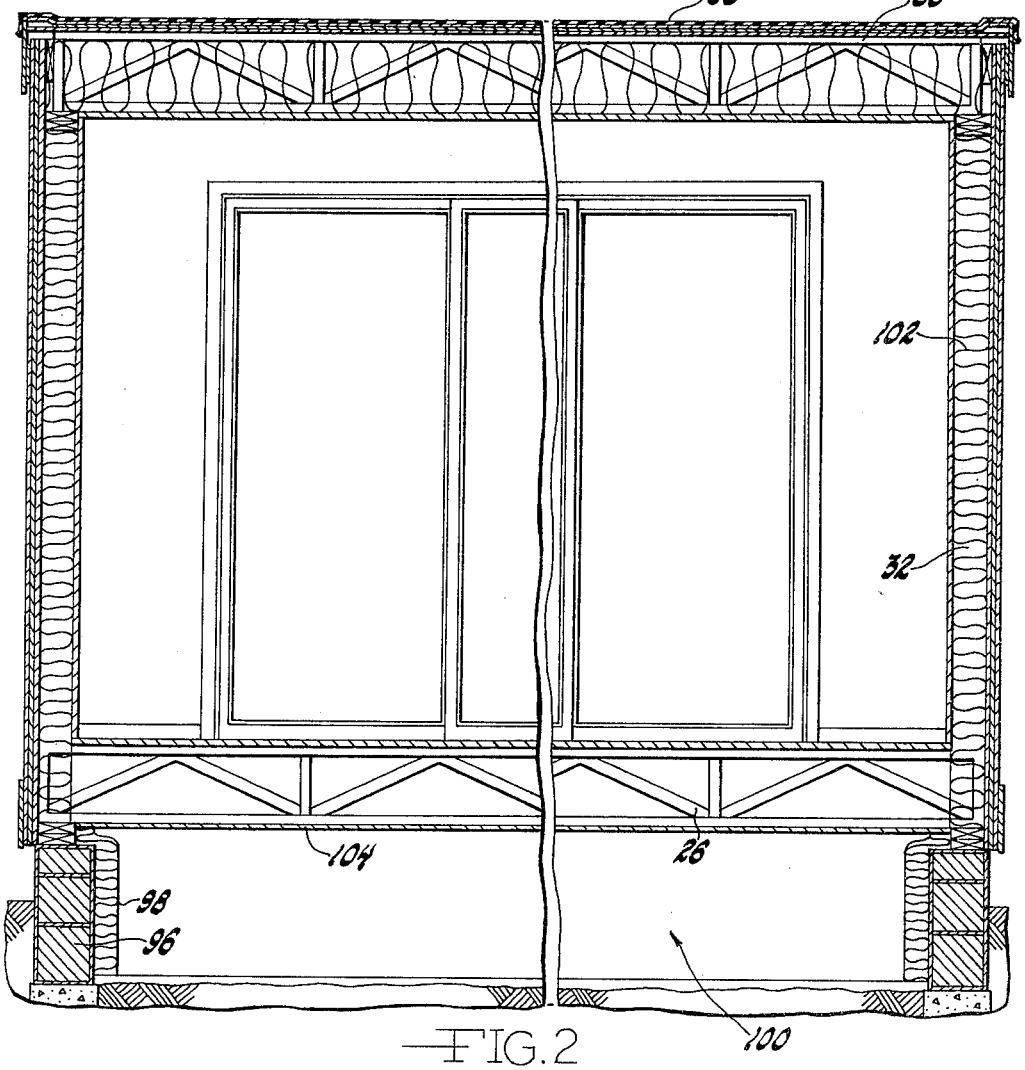
FIG. 2 is a vertical cross-sectional view through the lower module shown in FIG. 1, and showing the support therefor.
Figure 3:
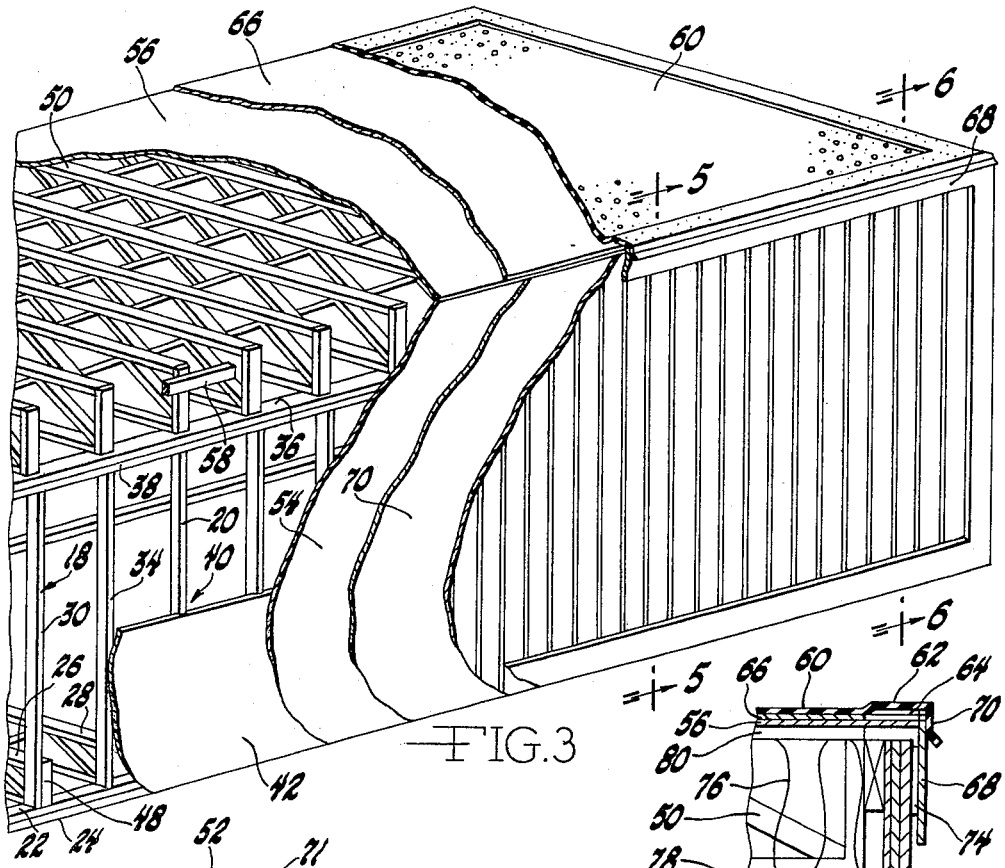
FIG. 3 is a fragmentary perspective view with some elements broken away.
Figure 4:
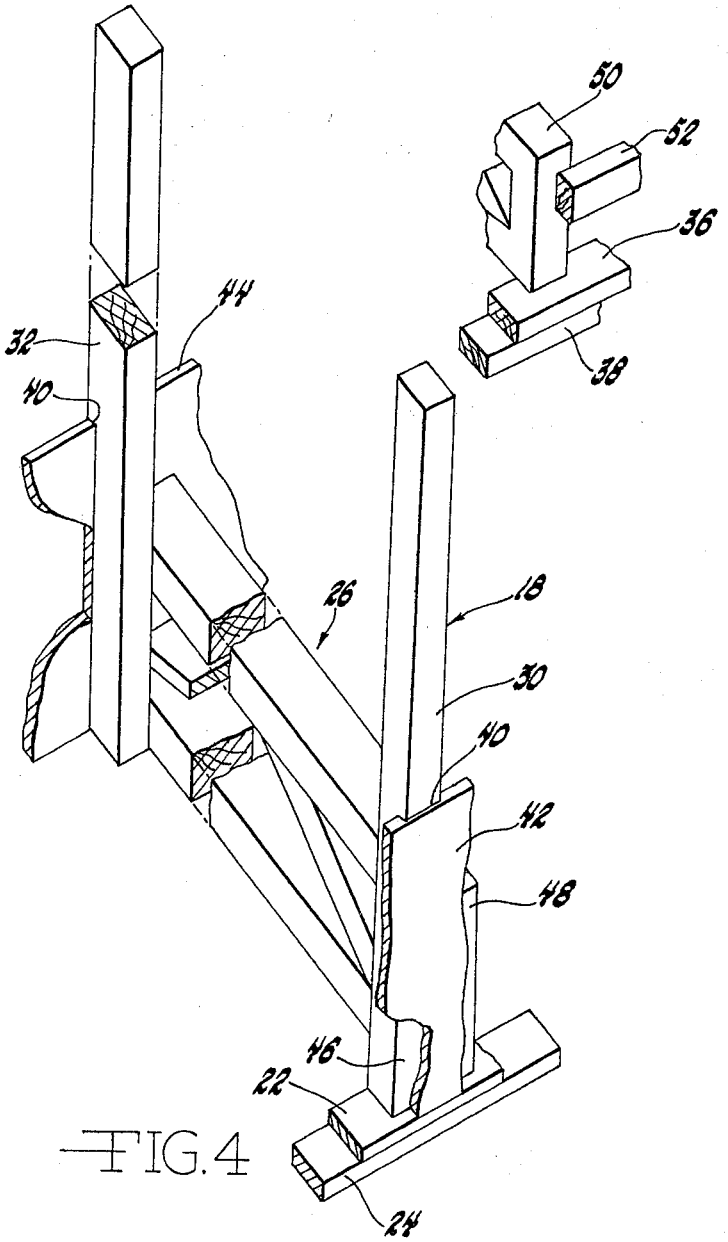
FIG. 4 is a fragmentary perspective view showing a U-shaped stress member.

Referring particularly to FIGS. 2-4 and the sectional views taken therein: a module constructed in accordance with the invention comprises a series of U-shaped stress members 18, and 20, arranged in spaced serial order lengthwise of the structure. They rest on a pair of plates 22 and 24 to which they are integrally attached. The stress members comprise horizontally positioned trusses, such as 26 and 28, and pairs of vertically extending elements 30, 32 and 34. The trusses are of the readily available type now used in home construction. The vertically extending members are preferably 2×6 inch studs. Plates 22 and 24 extend beneath these stress members and, similar plates 36 and 38 unite the upper ends of the U-shaped stress members.

The vertically extending elements 30 and 32 extend along the sides of the trusses 26 and are integrally united therewith by gluing and nailing. The vertical members 30 and 32 thus form a single U-shaped member with the truss. These members obviously can be preformed before uniting in a serial order as shown in FIG. 3. The 2×6 risers, or vertically extending elements, thus extend below what is normally considered to be the floor area of the module, and are more integrally united with the trusses than if they were simply resting on plates supported on the trusses. Loads tending to twist the building module embodying such U-shaped units are resisted by the overall U-shaped stress member. The upwardly extending risers are integral parts of the truss. It should also be noted that the risers are provided with notches 40 along their outer and lower faces. These notches are 4 feet in length, and are adapted to receive 4 foot sections of sheath-like stress panels, 42 and 44. The vertically extending riser elements 30 and 32 are positioned with their notched faces 46 flush with panels 48 of trusses 26.

The sheath-like stress panels 42 are preferably plywood sheaths of 4 foot width. With the notched faces 46 being positioned flush with the edge panels 48, the sheath-like stress panels abut both the inner faces 46 of the notch, and the end members 48. Thus, they can be integrally connected thereto by gluing and nailing, and form a load transmitting integral part of the structure with trusses 26 and 28 and with the risers 30, 32 and 34. The stress panels 42 and 44 extend along the complete lengths of the sides of the modules.

Upper trusses 50 are supported upon the plates 36 and 38, and provide roof support as well as means of integrally uniting the wall structure. The trusses are spaced inwardly from the edges of the plates 36 and 38 sufficiently to receive spacer members or nailers 52. In the preferred design illustrated, the upper trusses are 15 inch trusses, and the nailers are spaced 3 inches below the upper edge of the trusses for reasons hereinafter described.

It will be understood that the structure described with respect to the one side illustrated in FIG. 3 is the same as that used on the opposite side.

Further the sheath-like stress bands 42, and the vertically extending elements 30, 32 and 34, are united with a sheath member 54. This member is formed of tongue and grooved vertically extending panel members formed of ¾ inch plywood, and the members extend from the very lowermost point opposite the plates 22 and 24, and thus to the lowermost edge of the sheath-like bands 42, upwardly along the bands 42, then over and in contact with the risers 30 and 34, and finally into face to face contact with the nailer strips 52, and the upper plates 36 and 38. This sheath member is glued and nailed to all faces which it contacts, and thus forms a further integral part of the truss-beam construction.

Figure 6:
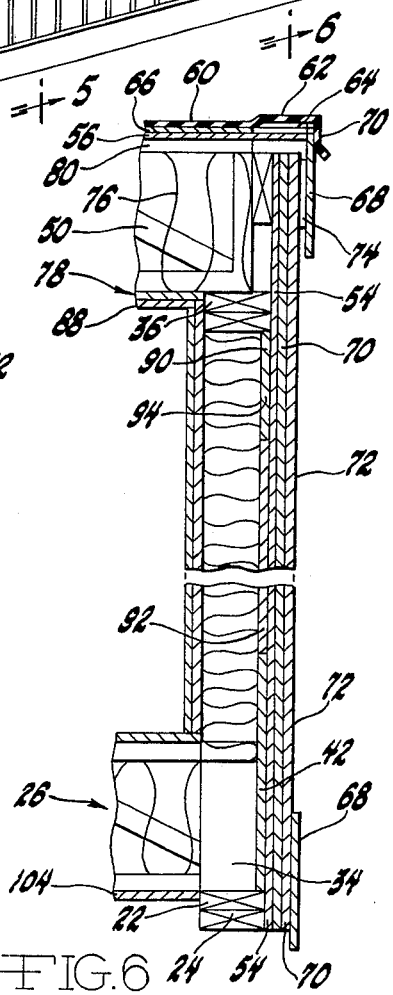
FIG. 6 is a sectional view taken along line 6—6 of FIG. 3.
Figure 5:
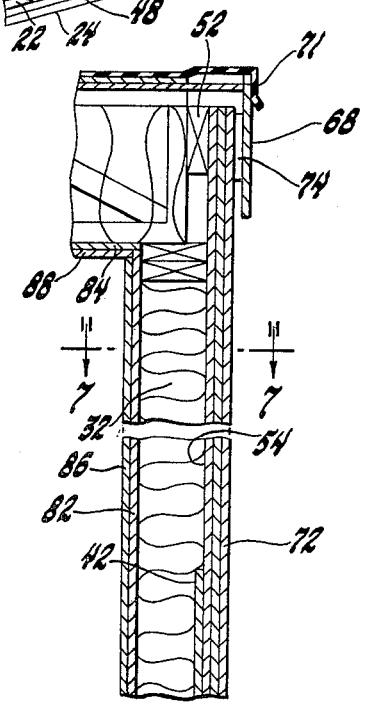
FIG. 5 is a sectional view taken along line 5—5 of FIG. 3.

The tops of the roof trusses are united by a sheath-like member 56. This member extends along the length of the trusses, and is again composed of tongue and groove elements integrally united, and turn integrally united to the trusses by nailing and gluing. As shown in FIGS. 5 and 6, this sheath-like member 56 projects at 58 beyond the edges of the trusses 50, and over the tops of the side forming structure.

The sheath 56 is in turn covered by a rubbery roof material, preferably of urethane, such as that referred to as the "Carlyle Rubber Roof". This material 60 can be obtained in sheets 15 feet wide and 48 foot long. This material extends completely over the sheath-like member 56. Near the edges there is provided a slight riser 62. This is accomplished by providing a spacer board 64 around the periphery of the roof. The roof also preferably includes a second sheath-like member 66 over the member 56. This is preferably formed of one-half inch rigid board, and extends the full length of the member 56. It is secured thereto by adhesive as well as nailing. Like the member 56, the member 66 projects beyond the end of the trusses to assist in supporting the end of the rubber roofing. The spacer board 64, and the two sheath-like members 56 and 66 are joined to a spacer and decorative molding piece 68 which projects downwardly from the edges of the members 66, 64 and 56. The rubber roof extends over the edge thus provided, and downwardly for a short distance along the molding 68 as indicated at 71.

The outer faces of the walls are finished by means of an insulating sheath 70. Preferably, this is formed of styrofoam and has two layers of foil, one at each side. This member extends the full length of the sheath 54. Over this member 70 there is provided decorative tongue and groove vertical siding 72.

As shown in FIGS. 5 and 6, the decorative piece 68 extends below the upper edge of the side wall, and is spaced therefrom. Inbetween the molding 68 and the upper surface of the wall there is provided a wire mesh barrier 74.

Insulation such as that shown at 76 is provided between the roof trusses, and above the ceiling construction indicated at 78. This insulation does not extend to the top of the trusses, but instead an air space is left between the trusses and beneath the sheath-like member 56, as shown at 80. The wire mesh barrier 74 provides for air flow through the space 80.

Figure 7:
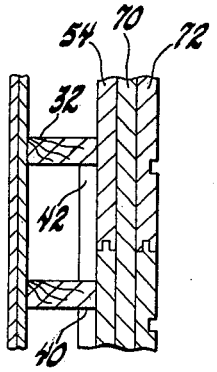
FIG. 7 is a sectional view taken along line 7—7 of FIG. 5.

The inner wall and ceiling are also preferably provided with insulating barriers such as sheath members 82 and 84. These are formed of a stryofoam type sheathing having double aluminium foil surfaces. Over this sheathing the typical plasterboard construction 86 and 88 is placed. With reference to FIGS. 5, 6 and 7, at the end of the units the sheath-like stress panels 42 extend completely up the vertically extending elements, such as 32. This is illustrated at 90. This is accomplished by cutting back the last three vertically extending elements 32 the ½ inch needed to permit the stress band to extend completely upwardly to the plates 36 and 38. The stress bands are formed at these ends by using a second sheet of 4 foot wider plywood, and a third sheet of 2 foot wide plywood thereabove as indicated at 92 and 94 respectively. This construction further rigidifies the box-beams at their ends where their greater shear stress may be in certain uses.

As shown in FIG. 2, the modules may rest on concrete blocks such as 96, and these may be provided with suitable insulations such as styrofoam sheets 98. Beneath the units there is provided a crawl space 100, which actually functions as a plenum chamber for the heating system. The base is leveled with fill sand preferably, and over this there is a 1 inch styrofoam insulation sheet, and above this 2 inches of P rock ballast. This cooperating with the full insulation along the walls, and extending up to the trusses provides a heat plenum chamber which can be used in various ways. For example, registers can be provided in the floor adjacent the perimeter of a housing unit to permit air to flow upwardly therethrough from beneath the crawl space and a return duct system can be provided centrally of the units to return the air into the space, and the heating devices can be in the crawl space. They can be either air or water heating means. Insulation is also packed into the walls between the vertically extending members 30, 32 and 34 as indicated at 102.

Since a module may be used as shown by the upper module 12 in FIG. 1, there is provided a lower covering sheath member, preferably of ½ inch plywood which extends completely over the bottom of the exposed floor trusses. This panel is indicated at 104, FIG. 2. Between the trusses, and within the space between the floor boarding and the lower sheathing, there is provided insulation similar to that employed in the walls and ceilings. This structure will be opened where necessary for heating ducts etc. when a module is mounted over a plenum as shown in FIG. 2. When mounted above another module, as in FIG. 1, openings will also be made as necessary for stairways, etc. Overhead heating units and other arrangements of heating and/or cooling devices such as heat pumps can obviously be used.

The full value of the U-shaped stress members is realized by using the modules in the manner shown in FIG. 1. In this instance, the module 12 extends from the lower module 10 a substantial distance across an open space 106. The box-beam like structure formed as described above provides adequate strength for this use of the modules.

It is possible to have a great variety of arrangement of modules. A number of homes can be built on the same site, but be given different appearances, and suited to differently shaped lots and slopes.

Further, the units are sufficiently rigid to be transported with ease without additional structural support, and can be mounted at the building sites, such as in the manner shown, without any additional structural support, except for the normal basement, and/or walls such as 14, yet an extremely rigid and strong building unit is provided, one which will give much satisfaction to the occupant. As also illustrated in FIGS. 1 and 2, various combinations of windows and doors and decks can be provided.

While I have shown and described preferred forms of the invention, it will be understood that other forms and variations can be devised within the scope of the invention and that accordingly the invention is to be limited only to the claims appended hereto.

We claim:

1. A box building module comprising a series of U-shaped stress members arranged in spaced serial order lengthwise of said module;

each stress member comprising a horizontally positioned truss and a pair of vertically extending elements;

said elements being positioned respectively at spaced locations along said truss and extending vertically along said truss and then above said truss a substantial distance;

the portion of each of said elements positioned along one of said trusses being secured thereto in load transmitting manner;

a horizontally extending vertically positioned sheath-like stress band extending along the full length of said series of stress members and secured in stress transmitting manner to said vertically extending elements thereof for a substantial portion of their vertical extent to form a rigid stress absorbing unitary side structure;

said horizontally positioned sheath-like stress band being received within notched portions of said vertically extending elements of said stress members;

said horizontally positioned stress band also being secured to the full height of said truss members at the connection thereto of said vertically extending elements of each of said U-shaped stress members;

a sheath member extending vertically along the full length of said U-shaped stress members and being affixed to said horizontally extending sheath-like stress band for the full extent thereof and to said vertically extending element for the full extent thereof above said horizontally disposed sheath-like stress band; and an upper member joining said U-shaped stress members to form a roof means integrally connected to the upper ends of said U-shaped stress members and to form therewith a substantially rigid box-beam housing unit capable of spanning a substantial distance between supports.

2. A box-beam housing module comprising:

a series of substantially U-shaped stress members arranged in spaced serial order lengthwise of the structure of the module;

each stress member comprising a horizontally positioned truss and a pair of vertically extending elements;

said elements being positioned respectively at spaced locations along said truss, and extending vertically along said truss and then above said truss a substantial distance;

the portion of each of said elements positioned along each one of said trusses being secured thereto in load transmitting manner; and a horizontally extending vertically positioned sheath-like stress band extending along the full length of said series of U-shaped stress members and secured in stress transmitting manner to said vertically extending elements thereof for a substantial portion of their vertical extent to form a rigid stress absorbing unitary side structure.

3. The structure of claim 2, wherein:

said horizontally positioned sheath-like stress band is received within notched portions of said vertically extending elements of said stress members and extending from the lowermost ends thereof upwardly a substantial distance.

4. The structure of claim 3, wherein:

said horizontally positioned stress band is also secured to the full height of said truss members at the connection thereto of said vertically extending elements of each of said U-shaped stress members.

5. The structure of claim 2, 3 or 4, including:

additional longitudinally disposed sheath-like members forming extensions of said stress band positioned at the respective longitudinal ends of said structure, and each abutting said stress band thereat, and extending thereat upwardly to the full extent of the vertically extending elements of said U-shaped stress members.

6. The structure of claim 3 or 4, including:

a sheath member extending vertically along the full length of said series of U-shaped stress members and being affixed to said horizontally extending sheath-like stress band for the full extent thereof and to said vertically extending elements for the full extent thereof above said horizontally disposed sheath-like stress band.

7. The structure of claim 6, wherein:

said sheath member comprises vertically arranged tongue and groove members united to form a unitary sheath.

8. The structure of claim 6, including:

an insulating sheath member extending over the full extent of said sheath member and secured thereto, and a decorative outer covering over said insulating sheath member.

9. The structure of claim 6, including:

a roof comprising roof forming truss members extending horizontally above said vertical elements and horizontally across said module over opposed pairs of said vertically extending elements and being secured to the latter.

10. The structure of claim 9, wherein:

said sheath member extends above said vertically extending elements of said U-shaped stress members and is secured to said roof forming truss members thereabove to form a single stress transmitting interconnection between said U-shaped stress members and said roof trusses as well as said horizontally positioned sheath-like stress band.

11. The structure of claim 9, wherein:

said roof trusses, said vertically extending elements of each said U-shaped stress member, said horizontally positioned sheath-like bands and said sheath member are secured to each other completely along their contacting faces.

12. The structure of claim 9, wherein:

said roof comprises a continuous elastomeric membrane and a pair of supporting members, the latter comprising a first roof sheath extending over the full length of said roof trusses and supported thereby, and forming therewith a continuous roof supporting means.

13. The structure of claim 12, including:

a sheath-like stress member extending beneath said U-shaped stress members, and secured integrally thereto to form a continuous structure including said U-shaped members, said roof members and stress transmitting sheathing integrally uniting said members.

14. The structure of claim 8, 11 or 12, including:

means forming a plenum chamber beneath said module comprising a continuous perimeter wall extending around a substantial portion thereof, and supporting at least a portion thereof, means extending inwardly of said plenum chamber and defining the lower extent of said chamber, the latter comprising a membrane, means beneath said membrane forming a level support therefor, and insulating means above said membrane comprising a foam-like member and a rock-like ballast.

* * * * *